United States Patent [19]

DeCecca

[11] Patent Number: 5,028,961

[45] Date of Patent: Jul. 2, 1991

[54] DEVELOPMENT APPARATUS HAVING A DEVELOPER MATERIAL STORAGE CHAMBER WHICH AUTOMATICALLY DISCHARGES UPON OPERATION OF THE MIXER

[75] Inventor: Michael L. DeCecca, Fairport, N.Y.

[73] Assignee: Eastman Kodak Company, Rochester, N.Y.

[21] Appl. No.: 570,186

[22] Filed: Aug. 20, 1990

[51] Int. Cl.[5] ..... G03G 15/06

[52] U.S. Cl. ..... 355/260; 355/245; 118/653; 118/657

[58] Field of Search ..... 355/245, 260, 200; 118/653, 657; 222/DIG. 1

[56] References Cited

U.S. PATENT DOCUMENTS

| | | | |
|---|---|---|---|
| 4,397,546 | 8/1983 | Burdette | 355/245 |
| 4,460,267 | 7/1984 | Ogawa | 355/260 |
| 4,615,608 | 10/1986 | Mizutani | 355/245 |
| 4,625,895 | 12/1986 | Tsukano | 222/63 |
| 4,785,331 | 11/1988 | Oka et al. | 355/208 |
| 4,797,704 | 1/1989 | Williams et al. | 355/260 |
| 4,873,549 | 10/1989 | Tada et al. | 355/260 |

FOREIGN PATENT DOCUMENTS

| | | | |
|---|---|---|---|
| 0188878 | 7/1989 | Japan | 355/260 |

*Primary Examiner*—A. T. Grimley
*Assistant Examiner*—Christopher Horgan
*Attorney, Agent, or Firm*—Tallam I. Nguti

[57] ABSTRACT

A development apparatus includes a toner container portion which is isolated from the toner mixing portion of the apparatus by a spring-mounted rotary gate that is keyed to the toner paddle mixing device of the apparatus such that rotation of the paddle mixer automatically opens the rotary gate, discharging the developer material into the mixing chamber.

10 Claims, 3 Drawing Sheets

DEVELOPMENT APPARATUS HAVING A DEVELOPER MATERIAL STORAGE CHAMBER WHICH AUTOMATICALLY DISCHARGES UPON OPERATION OF THE MIXER

BACKGROUND OF THE INVENTION

Field of the Invention

This invention relates to development apparatus for use in an electrostatographic copier or printer, and more particularly, to such an apparatus which is precharged or preloaded for clean and safe field installation in such a copier or printer.

As disclosed, for example, in commonly assigned U.S. Pat. No. 4,797,704, the use, in electrostatographic copiers and printers, of development apparatus which have been precharged or preloaded with developer material, is well known. The developer material used in the precharging may be single component consisting only of toner particles, or two-component consisting of carrier particles and toner particles. Where two-component developer material, as such, is used, the development apparatus will include mixing means, in addition to means for moving and applying the mixed developer material to an image to be developed.

Typically, a precharged or preloaded development apparatus includes a replenishment toner particle chamber and a mixing chamber. The mixing chamber is precharged or preloaded with developer material. The mixing chamber also contains the means for moving and applying the developer material, as well as the means, as in the case of two-component developer material for mixing the same. In the latter case, effective mixing can be achieved, on the one hand, only if the quantity of developer material requiring mixing is small enough so as to be directly impacted and moved by the mixing means which can be a small auger or a small ribbon blender.

On the other hand, there is an important need and desire to make such precharged apparatus last a reasonably long time after installation. Typically, in order for such a precharged development apparatus to last a reasonably long time, the mixing chamber, for example, has to be made reasonably big, thereby resulting in a big overall apparatus. Unfortunately, when the apparatus is that big, a small auger or small ribbon blender will occupy only a small portion of its mixing chamber. Therefore, in order not to end up with ineffective mixing as discussed above, the precharged mixing chamber ordinarily will contain only a very small amount of two-component developer material in such a big mixing chamber. Such a small quantity of loose powdery material in such a big chamber undesirably will cause problems.

For example, during the handling of such a precharged or preloaded apparatus prior to its installation in a copier or printer, it is reasonable to expect that the apparatus will be moved and placed in several of various orientations. As a result, the small quantity of developer material therein will undesirably be caused to move about substantially and turbulently within the rest of the mixing chamber. Since such a mixing chamber in a development apparatus has to be open to the outside of the apparatus for image development, such substantial and turbulent movement of the small quantity of preloaded developer material is likely to result (i) in aeration of the toner particles, (ii) in leakage, and (iii) even in undesirable contamination of adjacent components within a host copier or printer.

Where a lid, cover or seal is used in such a development apparatus to close the development opening into the mixing chamber, such substantial and turbulent movement is still likely to soil the lid or cover with developer material in such a manner that removal of the lid or cover by an operator becomes a very messy job. Consequently, there is a need to provide a precharged, that is preloaded, development apparatus which is capable (i) of utilizing two-component developer material, (ii) of lasting a relatively long period of time, and (iii) of clean and contamination-free field installation in a host copier or printer.

SUMMARY OF THE INVENTION

It is, therefore, an object of the present invention to provide a long lasting replaceable development apparatus which is precharged or preloaded with developer material for field installation and use in an electrostatographic copier and printer.

It is another object of the present invention to provide such a development apparatus which is capable of utilizing two-component developer material.

It is a further object of the present invention to provide such a development apparatus which is capable of clean and contamination-free handling during field installation.

In accordance with the present invention, a replaceable development apparatus, installable in an electrostatographic copier or printer, is provided for developing images formed electrostatically on an image-bearing surface of such a copier or printer. The development apparatus includes a housing having first, second, and third chambers therein.

The first chamber has means within it for mixing and transporting two-component developer material consisting of carrier particles and toner particles. The second chamber is suitable for holding and supplying fresh replenishment toner particles into first chamber to be mixed with depleted developer material therein. The third chamber is for immovably prestoring the developer material to be mixed in the first chamber. The third chamber, as such, has means for cleanly and safely isolating the developer material prestored in such third chamber, and means for automatically releasing such developer material into the first chamber after installation, and at initial start-up of the development apparatus in such a copier or printer.

BRIEF DESCRIPTION OF THE DRAWINGS

In the detailed description of the invention presented below, reference is made to the accompanying drawings, in which:

FIGS. 3A and 3B are the same as FIGS. 1A and 1B except that the developer material in the third chamber has been discharged into the first chamber for mixing.

DETAILED DESCRIPTION OF THE INVENTION

Figure 1A:
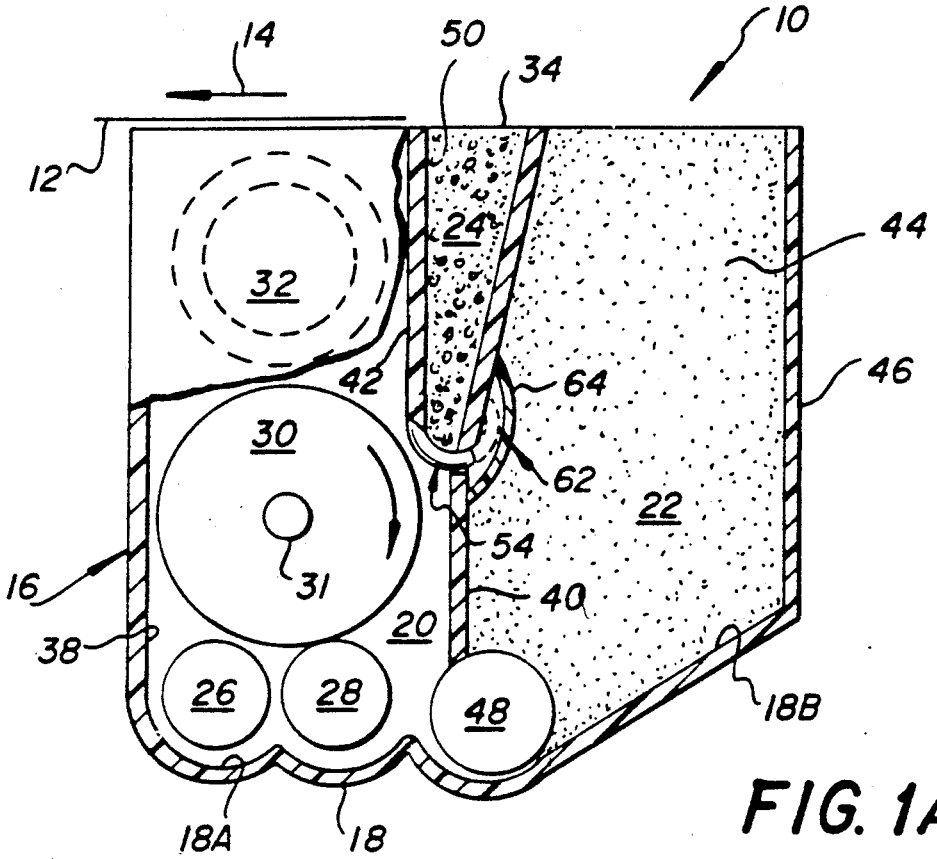
FIG. 1A is a schematic end view, partly in section, of the development apparatus of the present invention showing the second and third chambers precharged.

Referring now to the drawings, a replaceable development apparatus installable in an electrostatographic copier or printer is generally designated 10. The apparatus 10 can be field installed, for example, in such a copier or printer for developing latent images formed electrostatically by the copier or printer on an image-bearing surface 12. When installed in a copier or printer, the development apparatus 10 will be located relative to the image-bearing surface 12 as illustrated in FIG. 1. The surface 12 usually is moved relative to the apparatus 10 as shown, for example, in the direction of the arrow 14.

As shown, the development apparatus 10 includes a housing 16 which has a bottom or lower portion 18, a first chamber 20, a second chamber 22, and a third chamber 24. The first chamber 20 has mixing means such as a pair of mixing augers 26, 28 for mixing two-component developer material consisting of carrier particles and toner particles. In addition, the first chamber 20 also has developer material transport means such as a paddle wheel mixer 30. As shown, the transport means 30 is rotatable about a shaft 31, and is located between developer material applying means, such as a magnetic development roller 32, and the mixing means 26, 28. The transport means or paddle wheel mixer 30 can be driven by drive means such as a motor M (FIG. IB), coupled to a full gear 36.

As shown in FIGS. lA and IB, the first chamber 20 is defined, in part, by a bottom wall 18A, an outside side wall 38, a portion of the cover 34, and partially by a first interior wall 40, as well as partially by a second interior wall 42. Within the first chamber 20 as defined, the cover 34 includes an opening (not shown) through which developer material is moved for developing the images on the surface 12. The second chamber 22, as shown, is precharged or preloaded with fresh replenishment toner particles 44 which are to be used in the first chamber 20 for replenishing and mixing with developer material that has been depleted of toner particles following image development.

In order to make the apparatus 10 long lasting following installation in a copier or printer, it is desirable that the second chamber 22 contain as much replenishment toner as possible, and so the chamber 22 is made as large and as tall as possible. The first chamber 20 will therefore also be equally as tall. As a consequence the mixing augers 26, 28 will occupy only a small fraction of the volume of the first chamber 20.

The second chamber 22, as shown, is defined in part by an inclined bottom wall 18B, an outside side wall 46, a portion of the housing cover 34, and the first interior wall 40. The bottom of the interior wall 40 is spaced from the bottom walls 18A and 18B of the housing 16 in order to create an opening from the second chamber 22 into the first chamber 20. A rotatable compressed foam roller 48 can be mounted across this opening to act as a seal against toner particle flow. However, when rotated by suit- able means (not shown) the roller 48 will supply fresh replenishment toner particles from the second chamber 22 into the first chamber 20 for mixing with toner-depleted developer material in such first chamber.

In the precharged or preloaded development apparatus 10 of the present invention, because the first mixing chamber 20 includes an opening at the top in the cover 34, and because the appropriate quantity of developer material to be mixed therein will occupy only a small part of the volume of the chamber 20, such an appropriate quantity of developer material 50 is prestored instead in the third chamber 24. As such, the mixing chamber 20, as shown in FIG. 1, is empty of developer material until after installation and initial start-up of the development apparatus 10 in a copier or printer. As illustrated, the third chamber 24 is located in an upper portion of the housing 16, such that it is at least partially above the mixing means 26, 28. The chamber 24 is defined, in part, by the top portion of the first interior wall 40, a portion of the housing cover 34 and the second interior wall 42 on the first chamber side of the wall 40.

The top portion of the first interior wall 40, as shown, is angled towards the second chamber 22, and the second interior wall 42 extends from the cover 34 only partially down close to, but spaced from, the angled point of the wall 40. This arrangement forms a discharge aperture 52 (FIG. 4A) from the third chamber 24 into the bottom portion of the mixing chamber 20.

When the chamber 24 is precharged as shown in FIG. 1 with two-component developer material 50, the material 50 will be cleanly and safely isolated by the chamber defining walls 34, 40, 42, and by a rotatable gate 54. As shown in the drawings, the gate 54 has a first position (FIGS. 1A, 3) for closing and sealing the developer material discharge aperture 52, and a second position (FIG. 4A) away from, and thus opening, the discharge aperture 52. The aperture 52 is located relative to the storage area of chamber 24 such that when the gate 54 is moved to its second and open position, all the developer material 50 prestored in the chamber 24 will automatically and gravitationally discharge into the first, mixing chamber 20 over the mixing augers 26, 28.

In the present invention, in order to prevent aeration and toner clouds within the chamber 24 when closed, the chamber 24 is made so that it has a volume substantially equal to the volume of an appropriate quantity of developer material 50 that will be mixed effectively by the augers 26, 28 when discharged into the first chamber 20. As discussed above, such effective mixing can be achieved only if substantially all the material to be mixed can be directly impacted and moved by such augers. Such effective mixing, of course, is important for quality image development. Given this important size limitation to the chamber 24, it should then be precharged or pre-loaded with only enough developer material 50, so as to make such quantity 50 of developer material therein immovable, or in other words, so as to prevent any significant movement of such quantity of material therein with the gate 54 closed.

The size of the aperture 54, and the preloading of the material 50, however, should be such as to allow the complete and free flow of the material 50 from the chamber 24 when the gate 54 is open. When this is done, handling of the precharged or preloaded apparatus 10 in various orientations will not result in significant movement of the quantity of material 50 prestored in the chamber 24, and hence there will be no aeration or dusting which might cause toner particle leakage and contamination.

Figure 1B:
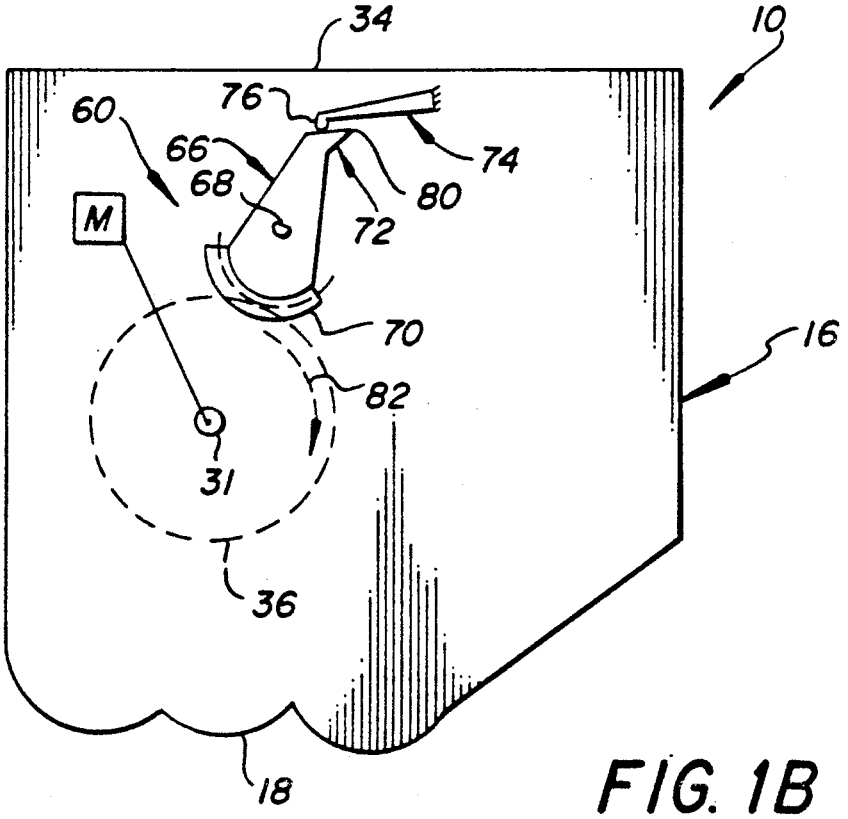
FIG. 1B is a schematic end view of the development apparatus as shown in FIG. 1A.
Figure 2:
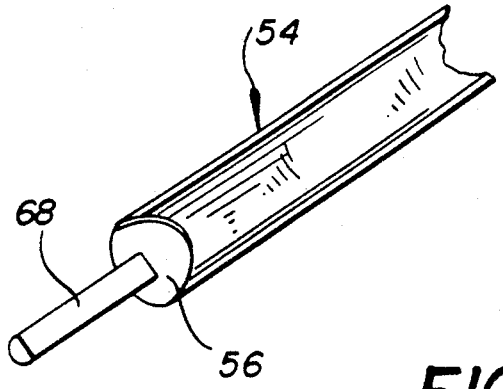
FIG. 2 is a perspective view of one end of the symmetrical rotatable gate to the third chamber.

Referring now to FIGS. 1A–2, the rotatable gate 54 consists of a partial cylindrical shell which is pivotably mounted over the discharge aperture 54. The gate 54 includes a mounting plate 56 at each end. Only one such end of the gate 54 is shown in FIG. 2 since the other end is a mere mirror image thereof. The gate 54 includes means designated generally as 60 for moving it from its first and closed position over the aperture 54 (FIG. 1A and 3), to its second and open position (FIG. 4A) away from the aperture 54.

As shown in the drawings, the first interior wall 40 includes means 62 for receiving and concealing the gate 54 in such second and open position. The means 62 includes an opening in the first interior wall 40 from the third chamber 24 through to the second chamber side of the wall 40. An empty pocket may be formed therein by an auxiliary wall 64 as shown for concealing the gate 54. As mounted, the gate 54 can be rotatably swung from its first position through the opening in the wall 40 into the pocket formed by the auxiliary wall 64.

Figure 4A:
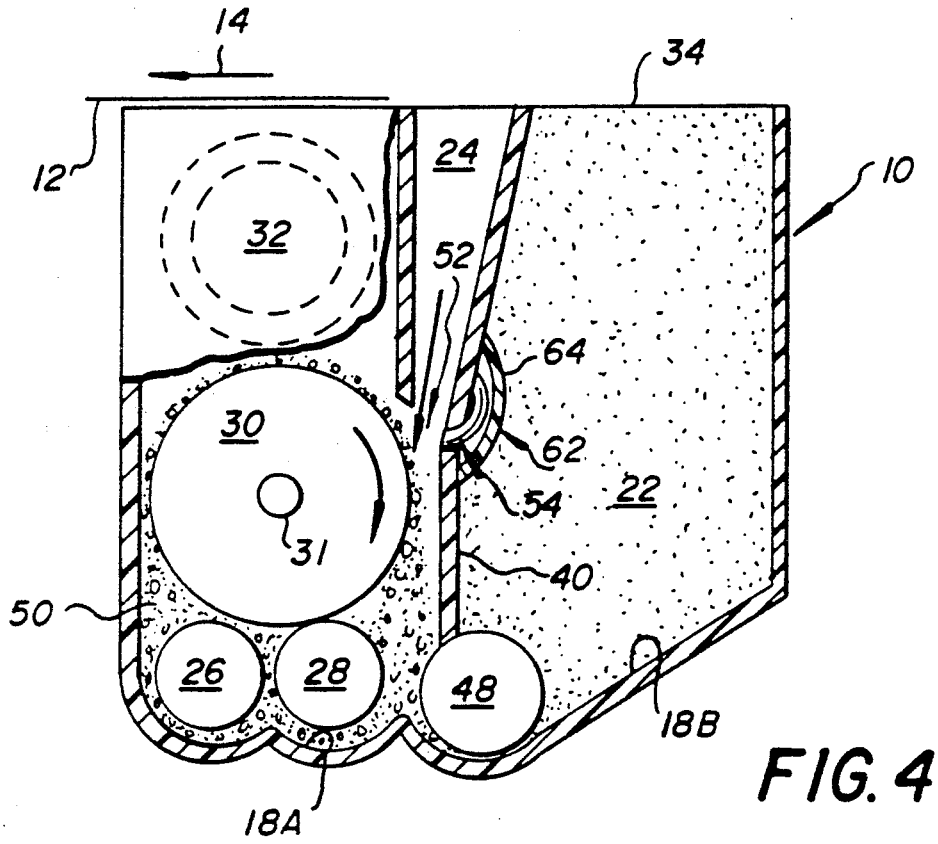
Figure 4B:
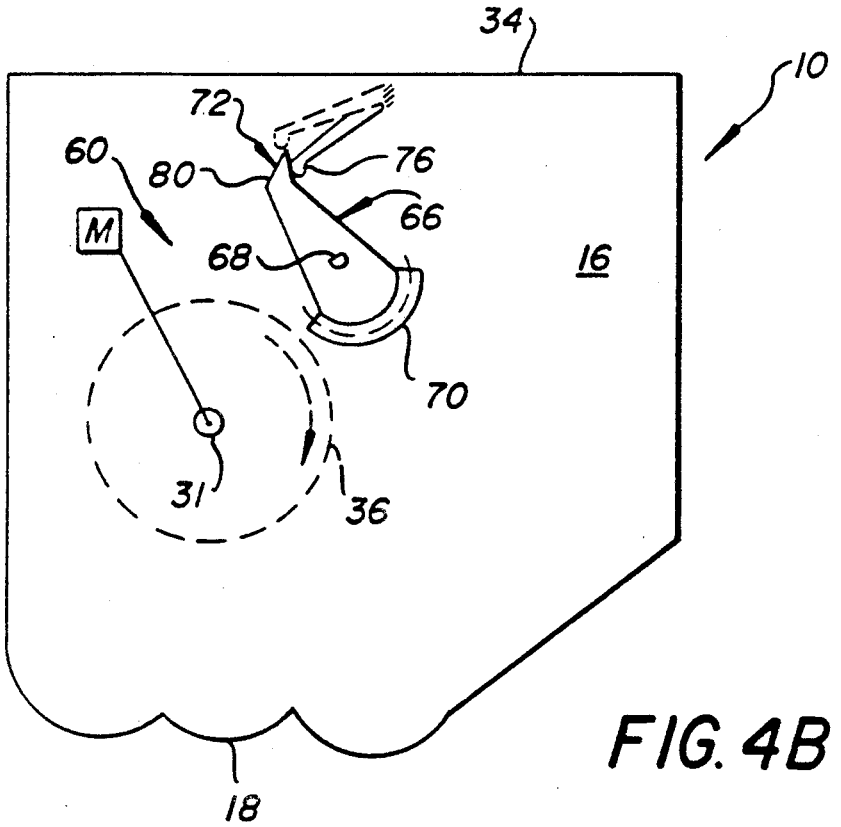

Referring now to FIGS. 1B and 4B, the means 60, for moving the gate 54 from its first position into its second position, includes the transport full gear 36 which is coupled, for example, by means of the drive shaft 31 to the paddle wheel transport means 30. The means 60 also includes the drive means M, a pivotable partial-gear lever member 66, and means such as a d-shaft 68 for connecting one of the mounting plates 56 of the gate 54 to the gear-lever member 66. The gear-lever member 66, for example, has a partial gear end 70, a cam end 72, and first and second positions as shown in FIG. 1B (first position), and in FIG. 4B (second position).

When the gate 54 is in its first position closing the aperture 54, the partial gear end 70 of the member 66 will be in meshing contact with the transport gear 36 as shown in FIG. 1B. The cam end 72 thereof will be held in its own first position (FIG. IB) by a cantilever spring 74. One end of the spring 74 is mounted to the housing 16, and the other, the free end, includes a rounded portion 76 which can follow a cam surface 80 on the cam end 72 of the lever member 66.

Figure 3:
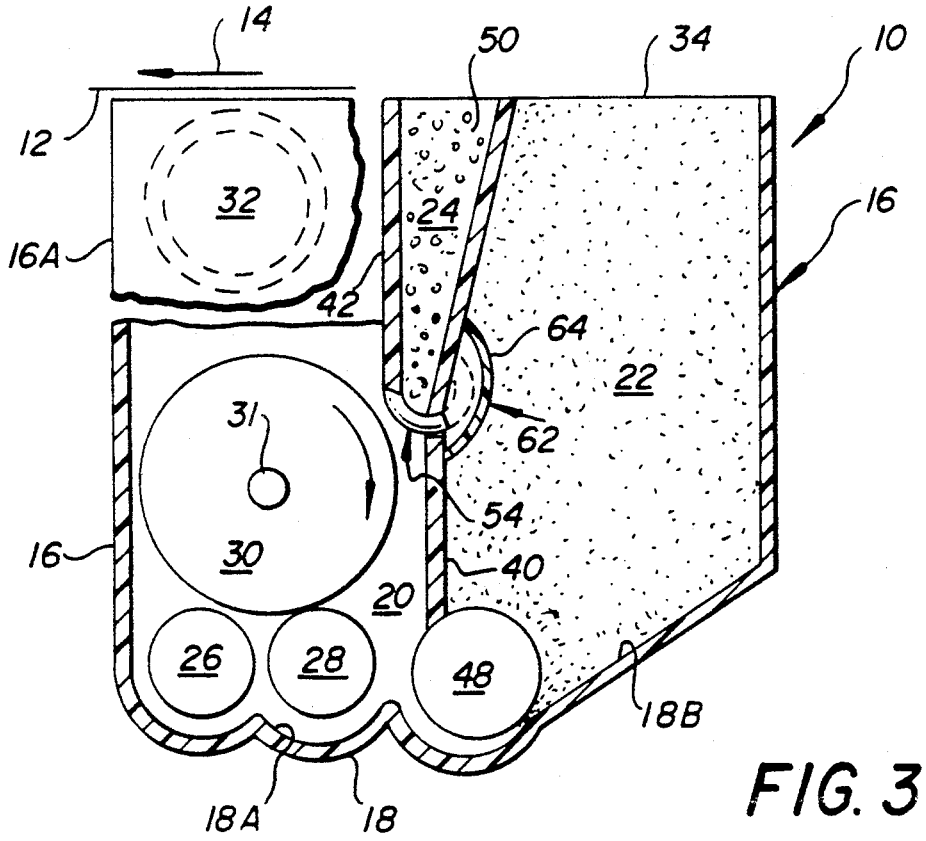
FIG. 3 is a schematic of an alternative embodiment of the development apparatus of FIG. 1A.

When the development apparatus 10 is precharged or preloaded with developer material 50 as shown in FIGS. 1A and 3, the gate 54 will be in its first and closed position, and the means 60 will be as shown, for example, in FIG. 1A, with the gearlever member also in its own first position. The development apparatus 10, as such, can be safely and cleanly handled in any convenient orientation, including the period during installation in a copier or printer. Once properly installed in a copier or printer, the apparatus 10 can then be started up for operation therein.

At initial start-up following such installation, the transport full gear 36 will be moved by the motor M in the direction of the arrow 82. Since the gear 36 is in mesh with the partial gear end 70 of the gear-lever member 66, gear end 70 will thus be moved by the gear 36 from its first position (FIG. 1B) towards its second position (FIG. 4B). At the same time, the rounded end 76 of the cantilever spring 74 will follow the cam surface 80 in a left-to-right direction according to FIG. IB. Such movement of the member 66, of course, directly moves the d-shaft key thereto, and hence the gate 54 from its first and closed position towards its second and open position. Moving or opening the gate 54, as such, will cause all the developer material 50 in the chamber 24 to discharge into the mixing chamber 20 (FIG. 4A).

During such movement of the gate 54, the free end 76 of the member 74 as shown in FIG. 4B will first be deflected or moved upwards by the indicated inclined portion of the surface 80 until such free end moves over the indicated edge thereon and drops back down into a lap or angled catching portion of the surface 80. The energy to deflect the spring, as such, is supplied by the moving gear 36. By the time the end 76 of the spring drops into the lap or catching portion of the surface 80, the partial gear end 70 of the member 66 would have been driven out of meshing contact with the gear 36 such that there is no longer a force or means tending to move it, as did the gear 36, in the counterclockwise direction as shown, for example. In addition, the rounded end 76 of the spring 74 being then within the angled or catching portion of the cam surface 80 will act to prevent the gear-lever member 66, and hence the gate 54 which is connected thereto, from each returning towards their respective first, and closed positions. The spring 74 functions, as such, to lock the gate 54 in its second and open position, thereby allowing all the developer material in the chamber 24 to be completely discharged into the mixing chamber 20.

As shown in FIG. 4A, developer material 50 discharged into the mixing chamber 20, as such, can thereafter be properly mixed by the augers 26, 28, and then transported by the means 30 to the development roller 32 for image development. As the concentration of toner particles in the chamber 20 decreases due to such particles being used up in such image development, fresh replenishment toner particles can be controllably metered from the toner holding chamber 22 by the roller 48 into the mixing chamber 20 for replenishment. Such replenishment will continue until the chamber 20 is empty of toner particles. Since the development apparatus 10 is replaceable, it then can simply be removed from the copier or printer, and a new and fully precharged or preloaded development apparatus 10 installed therein for similar initial start-up and operation.

Referring now to FIG. 3, an alternative embodiment of the development apparatus 10 of the present invention is shown. In this embodiment, the development roller 32 and a corresponding housing portion 16A about it are made to be fixed and permanent portions of a host copier or printer into which the apparatus 10 is to be installed. The apparatus 10 accordingly is therefore provided in the form of a precharged or preloaded cartridge that includes only (i) a portion of the mixing chamber 20 containing the developer material mixing and transport means, 26, 28 and 30, (ii) the toner holding chamber 22, and (iii) the developer material prestorage chamber 24. The mixing and transport means 26, 28 and 30 will be the same as described above, and so will be the chambers 22 and 24. The means 60 for moving the gate 54 following installation and initial start-up of the apparatus 10 in a copier or printer will also be as described above.

As can be seen, the present invention provides a replaceable precharged or preloaded development apparatus 10 which includes a large and tall developer material mixing chamber 20, and a large and tall toner particle holding chamber 22. The apparatus 10, as a consequence, is capable of lasting a relatively longer period of time before the need for replacement. By, in addition, including a small and appropriately sized developer material prestorage chamber 24, the apparatus 10 is made capable of utilizing two-component developer material, and particularly capable of clean and contamination-free handling and field installation.

The invention has been described in detail with particular reference to presently preferred embodiments, but it will be understood that variations and modifications can be effected within the spirit and scope of the invention.

What is claimed is:

1. A replaceable development apparatus installable in an electrostatographic copier or printer for developing images formed electrostatically on an image-bearing surface of such copier or printer, the apparatus comprising:

(a) a housing;

(b) a first chamber in said housing having means therein for mixing and trans- porting two-component developer material consisting of carrier particles and toner particles;

(c) a second chamber in said housing having means therein for holding and supply-ing fresh replenishment toner particles into said first chamber to be mixed with toner depleted developer material therein; and (d) a third chamber in said housing for immovably prestoring the developer material to be mixed in said first chamber, said third chamber having means for cleanly and safely isolating developer material prestored in said third chamber until after installation and initial start-up of said apparatus in a copier or printer, said isolating means being connected to said mixing and transporting means for automatically releasing the prestored developer material in response to operation of said mixing and transporting means.

2. The development apparatus of claim 1 wherein said developer material storage chamber is located in an upper portion of said housing.

3. The development apparatus of claim 1 wherein said developer material storage chamber includes a developer material discharge aperture thereform into said mixing chamber.

4. The development apparatus of claim 1 wherein said means for cleanly isolating developer material in said storage chamber comprises a cover portion of said housing, a first interior wall separating said developer material storage chamber from said toner particle holding chamber, a second interior wall separating said developer material storage chamber from said mixing chamber, and a rotatable gate having a first position for closing a developer material discharge aperture, and a second position away from, and thus opening said discharge aperture, thereby allowing developer material prestored in said storage chamber to discharge into said mixing chamber.

5. The development apparatus of claim 4 wherein said rotatable gate consists of a partial cylindrical shell mounted pivotably over said discharge aperture.

6. The development apparatus of claim 4 wherein said first interior wall includes means therein for receiving and concealing said rotatable gate in a second and opened position.

7. The development apparatus of claim 4 including means for moving said rotatable gate from said first closed position, into said open position, said moving means comprising:

(a) a full mixing gear coupled to said developer material mixing and moving means;

(b) drive means coupled to said full mixing gear;

(c) a pivotable partial gear-lever member having a first position in mesh with said full mixing gear when said rotatable gate is in said first and closed position, and a second position completely out of mesh and remote from said mixing gear when said rotatable gate is in said second and open position; and (d) means connecting said rotatable gate to said gear-lever member for movement therewith.

8. The development apparatus of claim 6 wherein said receiving means includes an opening through said first interior wall from said developer material storage chamber into the toner holding chamber side of said first interior wall, and an empty pocket formed on said toner holding chamber side about said wall opening for containing said rotatable gate in said open position.

9. The development apparatus of claim 7, including means for locking said rotatable gate in said open position.

10. The development apparatus of claim 9 wherein said locking means comprises a cantilever spring and a cam surface of a cam portion of said gear-lever member, said cam surface including an angled catching portion, and said spring including a rounded free end for following said cam surface, when said gear-lever member is moved from said first closed position into said second open position, into said catching portion thereof, thereby preventing said gear-lever member and said connected rotatable gate from returning to said first and closed positions.

* * * * *